United States Patent [19]

Hebert

[11] Patent Number: 4,914,940

[45] Date of Patent: Apr. 10, 1990

[54] EXHAUST MANIFOLD EXPANDER AND METHOD OF USING SAID EXPANDER

[76] Inventor: Merrill Hebert, 1454 E. Bridge St., P.O. Box 344, Breaux Bridge, La. 70517

[21] Appl. No.: 398,294

[22] Filed: Aug. 23, 1989

Related U.S. Application Data

[63] Continuation of Ser. No. 143,218, Jan. 6, 1988, abandoned, which is a continuation of Ser. No. 836,724, Mar. 6, 1986, abandoned.

[51] Int. Cl.[4] ..... B21D 3/16; B21D 3/12; B21D 19/04; B66F 3/36

[52] U.S. Cl. ..... 72/392; 29/239; 29/DIG. 105; 254/100; 254/102

[58] Field of Search ..... 72/392, 704, 705; 254/98, 100–102; 403/43, 44, 304; 474/113; 411/388, 389, 402; 29/239, 258, 264, DIG. 105

[56] References Cited

U.S. PATENT DOCUMENTS

| | | | |
|---|---|---|---|
| 1,629,189 | 5/1927 | Weaver et al. | 411/389 |
| 1,656,382 | 1/1928 | McColley | 254/101 |
| 2,181,163 | 11/1939 | Akins | 254/101 |
| 2,708,380 | 5/1955 | Mais | 254/102 |
| 3,154,291 | 10/1964 | Salyer | 254/102 |
| 3,333,555 | 8/1967 | Kapnek | 411/389 |
| 3,727,884 | 4/1973 | Custer | 254/100 |
| 3,869,934 | 3/1975 | Pierce | 254/100 |
| 4,492,500 | 1/1985 | Ewing | 411/402 |
| 4,549,423 | 10/1985 | Masui | 72/705 |

FOREIGN PATENT DOCUMENTS

| | | | |
|---|---|---|---|
| 14940 | 8/1911 | Denmark | 72/392 |

*Primary Examiner*—Robert L. Spruill

*Attorney, Agent, or Firm*—Pravel, Gambrell, Hewitt, Kimball & Krueger

[57] ABSTRACT

A manifold spreader which includes a main body portion having at its first end portion a recess in which is rotatably disposed a first end of an arm member. The arm member has a manifold engaging member on a second end thereof. A plurality of bearings mounted on the side of the arm member allows the arm member to freely rotate relative to the main body portion. The second end portion of the main body portion houses a screw member having on its first end a manifold engaging member. The body portion has a surface recessed therein to allow a wrench to engage and turn the main body portion.

In operation, the apparatus is placed intermediate a pair of manifold arm members such that the first and second end portions of the apparatus are making contact with the manifold arm members. The main body portion is rotated in a first direction, causing the screw member to move outwardly from the central body portion, thus causing the apparatus to expand and force apart the two manifold arm members.

10 Claims, 2 Drawing Sheets

EXHAUST MANIFOLD EXPANDER AND METHOD OF USING SAID EXPANDER

This is a continuation of co-pending application Ser. No. 143,218 filed on Jan. 6, 1988, now abandoned which is a continuation of co-pending application Ser. No. 836,724 filed on Mar. 6, 1986 now abandoned.

BACKGROUND OF THE INVENTION

1. Field Of The Invention

The apparatus of the present invention relates to automobile exhaust manifolds. More particularly, the present invention relates to an apparatus for positioning onto an automobile exhaust manifold, the function of the apparatus being to spread the manifold assembly casting members to align with the cylinder head for replacement thereupon.

2. General Background:

In the art of automobile exhaust systems, the automobile manifold is that piping structure which is attached to the cylinder head for receiving the heated exhaust gases that are released from the combustion chambers as the automobile engine cycles in operation. At present, the automobile exhaust manifold is engaged to the wall of the cylinder head via bolts, or the like attachments, having a common system leading into the manifold for the burned exhaust of the gases into the manifold and through the muffler and ultimately out of the exhaust.

Of course, during routine maintaince or repair of the automobile, often times the manifold has to be removed form the cylinder head, as for example when the block must be removed itself, which is done simply by removing the bolts attaching the manifold to the cylinder head. Upon replacement of the block or replacement of the manifold, often times due to the extreme heat that both the manifold and the cylinder head undergo during the operation of the engine, the bolt hole connections between the cylinder head and the manifold do not line up properly and in effect the manifold system "shrinks" so that when one aligns or attempts to align the holes of the cylinder head and the manifold, there is a misalignment, and the bolts can not be properly attached.

Therefore, at present, mechanics, or other types of repairmen, find many ways to expand or to spread the arms of the manifold out by hammering or by forcing them out through pressure of some type, so that the manifold will readjust itself to align with the bolt holes in the cylinder head. This is an on-going problem for mechanics, and lends itself to a need for a solution.

SUMMARY OF THE PRESENT INVENTION

The apparatus of the present invention solves the shortcomings in the art in a straightforward manner. What is provided is a manifold spreader which includes a principal body portion having at its first end a protruding first housing, housing a bearing whereby an arm member is rotatably mounted and may freely rotate as one end portion of the apparatus, the arm member having a means for engaging a manifold member. The second end portion of the principal housing houses a threadable screw member having on its end a manifold engaging member thereupon. The main housing further provides a means for grasping with a wrench or the like during use of the apparatus. In operation, upon placing of the apparatus intermediate a pair of manifold arm members, so that the first and second end portions of the apparatus are making engaging contact with each manifold arm member, the rotation of the central body portion, with a tool such as a wrench, will threadably move the second threaded screw member outwardly thus forcing the apparatus to "expand" and likewise expand the space between the respective manifold arms. Of course, the need to expand the arm members to align the holes in the manifold with the holes in the cylinder head will be determined by the number of turns of the center housing for movement of the threaded member outwardly.

Therefore, it is an object of the present invention to provide an apparatus for expanding the space between manifold casting arm members for attachment onto an automobile cylinder head;

It is still a further object of the present invention to provide an apparatus which enables easy positioning between respective casting arm members of an automobile manifold, and rotation of a portion of the apparatus for expanding the manifold outwardly;

It is still a further object of the present invention to provide an apparatus which includes first and second manifold engaging members on the ends of the apparatus so that rotation of a portion of the apparatus moves the engaging members further apart from one another and expands the manifold engaged thereonto.

DETAILED DESCRIPTION OF THE PREFERRED EMBODIMENT

Figure 1:
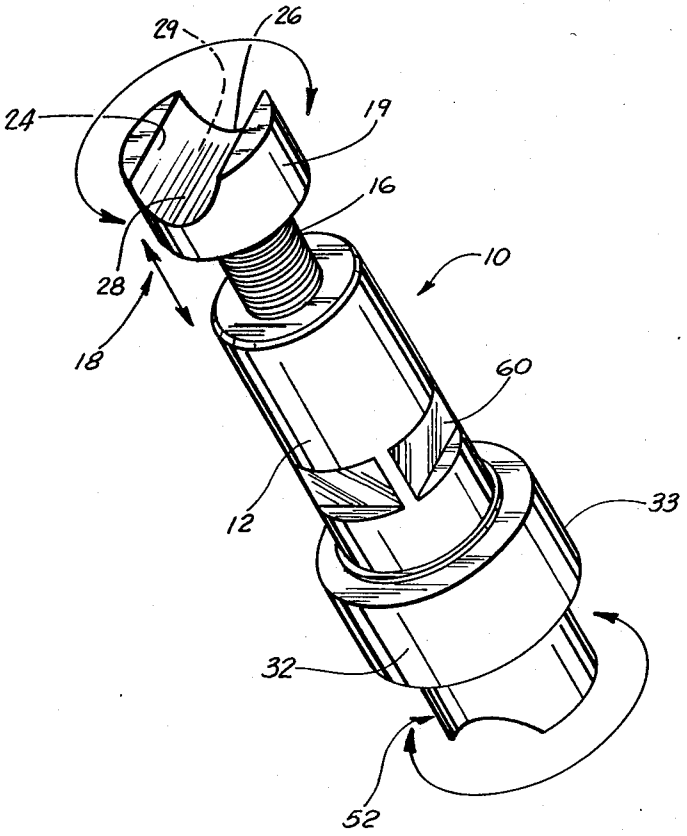
FIG. 1 is an overall perspective view of the preferred embodiment of the apparatus of the present invention.

The preferred embodiment of the apparatus of the present invention is indicated by the numeral 10 in FIG. 1. Exhaust manifold arm expander apparatus 10 comprises a main central body portion 12 having a first threaded bore 14 for accommodating threaded stud member 16 therein. On one end portion of threaded stud member 16 there is provided manifold arm engaging means 18 which comprises a ridig body portion 19 attached through welding or the like to threaded stud member 16, the body portion having angulated surfaces 24 and 26 and a bottom surface 28, the respective surfaces defining a space 29 for engaging the body portion of an manifold exhaust arm as seen in FIG. 3.

Figure 2:
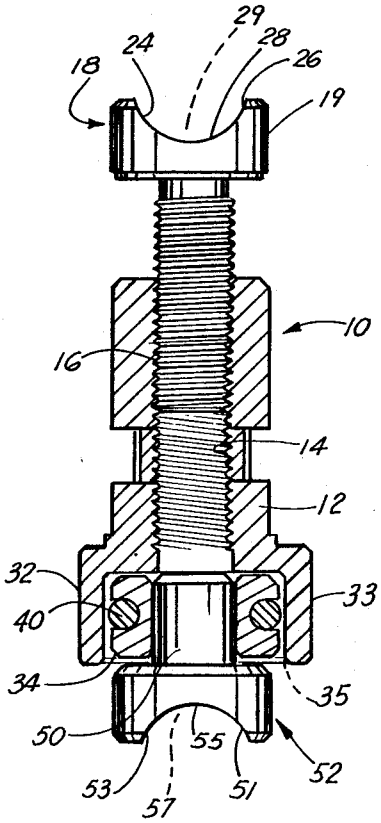
FIG. 2 is a partly cross-sectional, partially cutaway view of the preferred embodiment of the apparatus of the present invention.

On the second end of central body portion 12 there is rigidly incorporated an annular bearing mounting portion 32 which comprises a substantially annular protrusion 33 defining an internal recessed area 35 for accommodating a bearing housing 34. As seen in FIG. 2, bearing housing 34 would house a plurality of bearing member 40. Bearing housing 34 would accommodate a second exhaust manifold engaging member 50 so that free rotation of bearing housing 34 within mounting portion 32 would impart rotation to manifold engaging member 50. Manifold engaging member 50 would also comprise a body portion 52, identical to body member 19 of engaging means 18, and would have angulated surfaces 51 and 53 and a bottom surface 55 to define a second manifold engaging space 57 on the second end portion of apparatus 10.

For purposes of an explanation, it should be noted that second manifold arm engaging member 50 is free-rotating, with respect to mounting portion 32, together with bearing housing 34. The combined assembly spins freely, the function of which will be described further. Further structure involved in the apparatus includes a manual tool or wrench engaging surface 60 cut into the face of central body portion 12, for accommodating a wrench such as a crescent wrench or the like during use of the apparatus.

Figure 3:
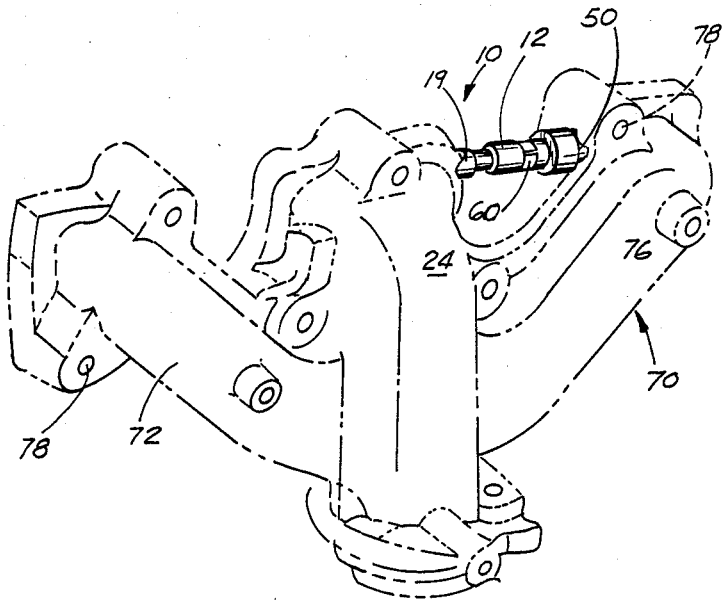
FIG. 3 is a side view of the preferred embodiment of the apparatus of the present invention illustrating it expanding between manifold arm members.

Making reference to FIG. 3, FIG. 3 illustrates apparatus 10 as mounted onto a manifold assembly 70 as seen in the Figure. As was described earlier, manifold 70 provides a plurality of manifold arm members 72, 74 and 76, each of the arm members having a plurality of bolt holes 78 for boltingly engaging the manifold assembly 70 onto the block of an engine.

For example, as illustrated in FIG. 3, as is often the case, when placing manifold 70 back into position after removal from the block, bolt holes 78 do not properly align with the holes in the engine block, and therefore, the assembly must often times be expanded in order to properly fit. Therefore, in operation, apparatus 10 is placed intermediate, for example, arm members 74 and 76, with engaging members 19 and 50 engaging the wall portions of arm members 74 and 76 respectively. Once the apparatus has been placed in position between the arm members 74 and 76, wherein each of the respective engaging members 19 and 50 are engaging the body of the arm members 74 and 76, main body portion 12 is then rotated via a wrench or the like by engaging surface 60 with a wrench. Upon rotation of body portion 12, since second engaging member 50 is free-rotating within bearing mounting portion 32 but is engaged upon arm member 76 of the manifold, second engaging member 50 remains therefore, stationary. Likewise, on the opposite end of the apparatus 10, since first engaging member 18 is likewise engaging the arm members 74 of the manifold, it is unable to rotate, and therefore also remains stationary. However, as main body portion 12 is rotated via surface 60, since the engaging members 19 and 50 cannot rotate, with each turn of the main housing member in the clockwise direction, the threaded screw member 16 is being unthreaded, and therefore is expanding the end members 19 and 50 further apart. Therefore, one is able to freely rotate the central body portion 12, but yet achieve expansion of the apparatus 10 which would in turn force the adjacent arm members 74 and 76 outwardly to a point where bores 78 are in alignment with the bores (not shown) in the block. Following the placement of the bolts thereinto, the body portion 12 may then be rotated in the opposite direction which would in effect threadably move the engaging members 18 and 50 inwardly toward the main body portion 12 and disengage the apparatus 10 from the arm members 74 and 76. Of course, the apparatus 10 would then be placed in position between the manifold arm member 72 and 74 for likewise operation in expanding the distance between these two respective arm members.

Because many varying and different embodiments may be made within the scope of the inventive concept herein taught, and because many modifications may be made in the embodiments herein detailed in accordance with the descriptive requirement of the law, it is to be underdstood that the details herein are to be interpreted as illustrative and not in a limiting sense.

What is claimed as invention is:

1. A method of spreading the arms of an exhaust manifold utilizing an apparatus comprising:

(a) a central body portion having a recess at a first end therein;

(b) a first manifold engaging member rotatably disposed within the recess;

(c) a wrench-engaging surface recessed in the central body portion; and (d) a second manifold engaging member threadably attached to a second end of the central body portion such that rotating the central body portion in a first direction causes the second manifold engaging member to move outwardly away from the central body portion when the first and second manifold engaging members are held in non-rotating relationship;

said method comprising:

(i) positioning said apparatus between arms of a manifold which are to be spread; and (ii) rotating the central body portion to cause said second manifold engaging member to extend axially away from the first manifold engaging member and spread said arms of said manifold.

2. The method of claim 1, wherein:

each of the manifold engaging members has a recess therein which is shaped to fit a body portion of an exhaust manifold arm, the apparatus being sized to fit between adjacent arms of a manifold.

3. An automobile exhaust manifold arm-spreading apparatus comprising:

(a) a central body portion having a recess at a apparatus comprising:

(b) a first manifold-arm engaging member having a first end portion disposed in the recess of the central body portion and having a second end portion which has a recess therein which is shaped to fit a body portion of an exhaust manifold arm;

(c) a wrench-engaging surface recessed in the central body portion; and (d) a second manifold-arm engaging member having a first end portion which is threadably attached to a second end of the central body portion such that rotating the central body portion in a first direction causes the second manifold-arm engaging member to move outwardly away from the central body portion when the first and second manifold-arm engaging members are held in non-rotating relationship, the second manifold-arm engaging member having a second end portion which has a recess therein which is shaped to fit a body portion of an exhaust manifold arm, wherein the apparatus is sized to fit longitudinally between adjacent arms of an exhaust manifold.

4. The apparatus of claim 3, further comprising:

a plurality of bearings disposed between the first manifold-arm engaging member and the central body portion.

5. The apparatus of claim 3, wherein:

the central body portion is integral.

6. The apparatus of claim 3, wherein:

the recesses in the manifold-arm engaging members are substantially semi-cylindrical in shape.

7. An apparatus, for spreading arms of an exhaust manifold, comprising:

(a) an integral body portion having:

(i) a central threaded bore terminating at a first end of the central body portion;

(ii) an expanded-diameter outer body portion on a second end of the central body portion and having a recess therein; and (iii) a wrench-engaging surface recessed in the central body portion;

(b) a bearing housing disposed in the recess of the central body portion;

(c) a first manifold-arm engaging means having a first end portion disposed in the bearing housing and having a second end portion which has a recess therein which is shaped to fit a body portion of an exhaust manifold arm;

(d) a second manifold-arm engaging member having a first end portion which is threadably received in the central threaded bore of the central body portion such that rotating the central body portion in a first direction causes the second manifold-arm engaging member to move outwardly away from the central body portion when the first and second manifold-arm engaging members are held in non-rotating relationship, the second manifold-arm engaging member having a second end portion which has a recess therein which is shaped to fit a body portion of an exhaust manifold arm, wherein the apparatus is sized to fit longitudinally between adjacent arms of an exhaust manifold.

8. The apparatus of claim 7, wherein:

the manifold-arm engaging members and the central body portion are substantially cylindrical in cross section, and the diameters of the manifold-arm engaging members and the central body portion are substantially equal.

9. The apparatus of claim 8, wherein:

the recesses in the manifold-arm engaging members are substantially semi-cylindrical in shape.

10. The apparatus of claim 7, wherein:

the recesses in the manifold-arm engaging members are substantially semi-cylindrical in shape.

* * * * *